US010537903B2

(12) United States Patent
Sillince

(10) Patent No.: US 10,537,903 B2
(45) Date of Patent: Jan. 21, 2020

(54) SPRAY CAP FOR CONTAINER

(71) Applicant: INNOVATION JUNCTION LIMITED, Sussex (GB)

(72) Inventor: Mark Erich Sillince, Hampshire (GB)

(73) Assignee: INNOVATION JUNCTION LIMITED, Sussex (GB)

( * ) Notice: Subject to any disclaimer, the term of this patent is extended or adjusted under 35 U.S.C. 154(b) by 0 days.

(21) Appl. No.: 16/068,351

(22) PCT Filed: Jan. 5, 2017

(86) PCT No.: PCT/GB2017/050016
§ 371 (c)(1),
(2) Date: Jul. 5, 2018

(87) PCT Pub. No.: WO2017/118854
PCT Pub. Date: Jul. 13, 2017

(65) Prior Publication Data

US 2019/0015847 A1 Jan. 17, 2019

(30) Foreign Application Priority Data

Jan. 6, 2016 (GB) ..... 1600221.4

(51) Int. Cl.
*B05B 1/14* (2006.01)
*B05B 1/04* (2006.01)
(Continued)

(52) U.S. Cl.
CPC ..... *B05B 1/14* (2013.01); *B05B 1/044* (2013.01); *B05B 11/047* (2013.01); *B65D 47/2031* (2013.01)

(58) Field of Classification Search
CPC ..... B05B 1/14; B05B 1/047; B05B 11/047; B65D 47/2031
USPC ..... 222/484, 485, 490, 491, 481.5, 494, 222/203.15, 203, 11, 203.18, 203.27, 303, 222/367.1, 478, 92, 106, 212–216;
(Continued)

(56) References Cited

U.S. PATENT DOCUMENTS 3,490,488 A 1/1970 Grist
3,915,331 A 10/1975 Chenault
(Continued)

FOREIGN PATENT DOCUMENTS

EP 0011394 A1 5/1980
EP 2736695 B1 3/2015
(Continued)

OTHER PUBLICATIONS

Search Report issued in counterpart GB application No. 1600221.4, dated Jun. 23, 2016.
(Continued)

*Primary Examiner* — Lien M Ngo
(74) *Attorney, Agent, or Firm* — KAPLAN BREYER SCHWARZ, LLP

(57) ABSTRACT

A spray cap for a spray container constitutes a one-piece moulding of polymeric material and includes a cap plate in which a plurality of spray slits is formed. Integral with the cap plate is a non-return valve arranged to permit air to flow through it in one direction which, in use, is towards the interior of the spray container but substantially to prevent flow of air through it in the opposite direction.

19 Claims, 3 Drawing Sheets

(51) Int. Cl.
*B05B 11/04* (2006.01)
*B65D 47/20* (2006.01)

(58) Field of Classification Search
USPC ... 220/203.15, 203, 11, 203.18, 203.27, 303, 220/367.1
See application file for complete search history.

(56) References Cited

U.S. PATENT DOCUMENTS 4,057,177 A 11/1977 Laauwe
5,169,035 A * 12/1992 Imbery, Jr. ..... B65D 47/0814 222/212
5,472,122 A 12/1995 Appleby
5,890,619 A * 4/1999 Belanger ..... A47G 19/2272 220/713
6,176,399 B1 * 1/2001 Schantz ..... B65D 47/2031 222/484
6,951,295 B1 * 10/2005 Gaus ..... B05B 11/007 222/484
7,398,900 B2 * 7/2008 Friedman ..... B65D 47/0814 222/494
2012/0312895 A1 * 12/2012 Thurin ..... B05B 1/06 239/222.15
2013/0026677 A1 1/2013 Smith

FOREIGN PATENT DOCUMENTS

GB 1514237 6/1978
JP 1029652 A 2/1998

OTHER PUBLICATIONS

Authorized Officer: Rocchi, Sabrina, International Search Report and Written Opinion issued in counterpart PCT application No. PCT/GB2017/050016, dated Mar. 16, 2017.
Notice of Intention to Grant issued in EP patent application No. 17700383.7 with Text Intended for Grant, dated Jun. 11, 2019, 19 pp.

* cited by examiner

SPRAY CAP FOR CONTAINER

FIELD

The present invention relates to spray containers and, more particularly, to caps for such containers, which are commonly referred to as spray caps. Spray containers are used for dispensing a wide variety of liquids in spray or atomised form, such as deodorant, toilet cleaner, window cleaning fluid, olive oil and the like.

BACKGROUND

Spray containers typically consist of a receptacle for containing the liquid to be sprayed, connected to the upper end of which is a spray cap which includes a single spray orifice of very small diameter, typically 1 mm or less. In use, the liquid is supplied to the spray orifice under pressure and then flows through the orifice. The combination of the high pressure and the small diameter of the spray orifice results in the jet of liquid passing through the spray orifice being discharged from it in spray or atomised form. The pressurisation of the liquid supplied to the spray orifice may be effected in various ways, such as by a liquefied propellant gas contained within the receptacle, a hand-operated pump or by squeezing the wall of the receptacle, which must therefore be of flexible, resilient material. It is with this latter type of spray container that the present invention is concerned. If a pump or a propellant gas is used to generate the necessary pressure, the pressure is relatively high and the liquid is atomised, i.e. broken up into very fine droplets. If the pressure is applied by manually squeezing the wall of the receptacle, the pressure generated is relatively low and the liquid is dispensed in spray form, that is to say in the form of droplets which are significantly larger than those in an atomised spray.

In order to be able to manufacture spray caps it is generally necessary for the spray orifice to be formed in a separate nozzle component and for that component to be subsequently connected to the remainder of the spray cap, whereby conventional spray caps therefore generally include at least two components, which must be manufactured separately and then connected together. This results in a not insignificant manufacturing cost.

When a spray container of the type with which the invention is concerned is operated by squeezing the flexible container, the amount of liquid dispensed tends to be very small and it is generally necessary to squeeze the receptacle a number of times in order to dispense sufficient liquid. In order that the receptacle can return from its squeezed or deformed shape to its original, generally cylindrical, shape under the force of its own resilience it is necessary for a significant volume of air to enter the receptacle and it can generally do this only through the spray orifice. However, the very small diameter of this orifice means that this takes a considerable period of time, particularly as the sub-atmospheric pressure created in the receptacle by the resilience of its wall is very small, whereby the pressure differential which causes atmospheric air to flow into the container is very small also.

The spray issuing from a single spray orifice has a generally conical shape with the majority of the droplets being concentrated in an outer generally circular region and relatively few droplets in the area within the circular region. This means that the coverage of the sprayed liquid on a surface which is to be sprayed is very uneven and in order to obtain something approaching uniform coverage it is necessary to move the spray container from side to side or in a circular motion.

SUMMARY

It is the object of the present invention to provide a spray container and a spray cap for such a container in which the above disadvantages are eliminated or at least significantly reduced.

According to the present invention there is provided a spray cap constituting a one-piece moulding of polymeric material and including a cap plate in which a plurality of spray slits is formed and integral with which is a non-return valve arranged to permit air to flow through it in one direction which, in use, is towards the interior of the spray container but substantially to prevent the flow of air through it in the opposite direction. Thus the present invention provides a spray cap with a plurality of spray slits, rather than a single, generally circular spray orifice, and a one-way valve, which, in use, will permit air to be drawn back into the spray container very much more rapidly than it could be drawn back through the spray slits, which are inherently very small, thereby allowing the resilient container to return to its original undeformed shape very rapidly. The spray cap is a one-piece injection moulding and the entire valve may thus be made in a single step. The fact that there is a plurality of spray slits rather than a single spray orifice means that a greater area may be coated in a single spray operation and that the coverage is much more even than when using a single orifice.

It is preferred that each spray slit is defined by two edges of irregular shape, which substantially contact one another, at least in certain regions. It is further preferred that the width of each spray slit varies along its length between substantially 0 and 0.05 mm, more preferably 0.01 mm.

EP2736695A discloses a method of making a dispensing valve in a single injection moulding step. The valve includes one or more slits which define one or more valve flaps, which are movable under pressure with respect to the remainder of the valve to open or close the valve, or partially define two valve members which are movable under pressure with respect to one another to open and close the valve. The slit or slits are formed during the injection moulding process by providing one of the relatively movable valve members with an elongate formation including an apex, which, when the mould is in the closed configuration, is spaced from the opposed surface of the other mould member by a distance of only between 0.0075 and 0.075 mm to form a narrow elongate gap. When molten polymeric material is injected into the mould space it rapidly fills most of it but the narrow elongate gap forms a significant flow barrier and in practice the molten material approaches this gap and flows into it substantially symmetrically from both sides. The very small width of the gap means that the two fronts of plastic material will substantially meet along a line running along the apex but do not fuse together. This is believed to be due to the rapid cooling that occurs due to the narrowness of the gap and the resulting high rate of temperature drop that occurs above the apex. The fact that the two fronts meet but do not fuse together means that a discontinuity or slit is formed in the moulded product whose width is negligible or substantially zero. If the slit is viewed on a microscopic scale, it is seen that the two flow fronts do not advance into the gap along two straight lines but instead advance into it along two wavy or irregular lines. The two sides of the slit are therefore in contact at some areas and thus form a seal but are spaced apart by a microscopic distance at other areas.

Thus the prior document is concerned only with the formation of one or more slits during the injection moulding process for the purpose of at least partially defining one or more valve members, which are movable with respect to the remainder of the valve. In the spray cap of the present invention, the pairs of edges which define the spray slits are not movable with respect to each other and the spray slits are not valves in the usual sense of this word. The present invention is based on the recognition that the method of the prior document may be used to produce slits which are ideally suited to break up a flow of liquid into a fine spray and thus has an application broader than merely making a valve. The non-return valve incorporated in the spray cap of the present invention may, however, be made by the method in accordance with the prior document. However, the use of the method of the prior document permits the non-return valve and all the spray slits to be formed during the process of injection moulding the spray cap in a single operation, thereby making the manufacturing process considerably easier and cheaper.

The fact that the spray cap includes a plurality of spray slits rather than a single spray orifice means that a much greater degree of liquid coverage is obtained. The fact that the spray cap also includes a non-return valve arranged to permit air to flow into the spray container but to prevent both air and liquid flowing out of the container means that once the spray container has been squeezed, in order to pressurise its contents, and the pressure applied to it has been removed, in order to permit the container to return to its original shape prior to potentially squeezing it again, atmospheric air may flow into the container through the non-return valve and since the area of the opening in the non-return valve may readily be made substantially larger than that of a single spray orifice, air will flow into the container and the container will return to its original shape very rapidly.

It is preferred that each spray slit is defined by two edges of irregular shape which substantially contact one another, at least in certain regions. The optimum width or mean width of each spray slit will vary with the viscosity of the liquid to be sprayed. With relatively viscous liquids, the width of the slits may vary along their length between substantially 0 and 0.3 mm, preferably 0.1 mm. With liquids whose viscosity is lower and generally similar to that of water, narrower slits are desirable and in this case the width of each spray slit preferably varies along its length between substantially 0 and 0.05 mm, preferably 0.01 mm.

The spray slits may be disposed in any desired pattern but it is preferred that they are arranged in a substantially circular array.

The cap plate may be of any desired shape, but it is preferred that it is substantially circular and that the spray slits extend substantially radially.

The spray slits may be directed generally axially but a larger area of coverage is obtained if the cap plate includes an annular region which is inclined upwardly and inwardly and in which the spray slits are formed. This will result in the sprays discharged from the spray slits diverging outwardly from the axial direction.

The non-return valve is preferably of generally duckbill type including two valve plates which are inclined towards one another and are integral with the cap plate and whose ends remote from the cap plate are biased towards one another and are separated by a slit. Such a valve and a method of making it are described in detail in EP2736695A.

In use, the outer part of the spray cap will be connected to a spray container and is therefore preferably relatively robust and rigid to ensure that the connection is stable and secure. However, the inner part of the valve, in which the spray slits and the non-return valve are formed, is preferably relatively soft and flexible so that the non-return valve will form a reliable seal and the spray slits are appropriately narrow. These conflicting requirements may be met by selecting a material for the spray cap which adequately performs both functions but it is preferred that the spray cap consists of inner and outer regions of different plastic materials, the spray slits being formed in the inner region and the non-return valve forming part of the inner region. It is preferred also that the plastic material of the inner material is softer and more resilient than the plastic material of the outer region. This may be achieved by a known twin-shot moulding method in which the two portions of the spray cap are moulded sequentially from different materials in the same moulding process, e.g. by the known "core back" moulding process, to produce a one-piece moulding.

The spray cap preferably includes a closure cap moulded integrally with the cap plate and connected to it by an integral hinge, whereby the closure cap is movable between a closed position in which it covers the cap plate, and an open position, in which it does not. It is preferred that the cap plate has a recess formed in its upper surface and the closure cap has a projection formed in its underside which is received in the recess in the cap plate when the closure cap is in the closed position. It is preferred also that the outer surface of the projection and the inner surface of the recess carry a recess and a projection which cooperate to form a snap connection when the closure cap is in the closed position. The closure cap preferably includes a region on its underside which is shaped and positioned so that it comes into contact with the region of the cap plate in which the spray slits are formed, when the closure cap is in the closed position, whereby the spray slits are closed.

The present invention also embraces a spray container comprising an open-topped receptacle with a flexible, resilient wall and a spray cap as described above connected, e.g. snap-connected, to the top of the receptacle.

BRIEF DESCRIPTION OF THE DRAWINGS

Further features and details of the invention will be apparent from the following description of one specific embodiment, which is given by way of example only with reference to the accompanying drawings, in which.

DETAILED DESCRIPTION

Figure 1:
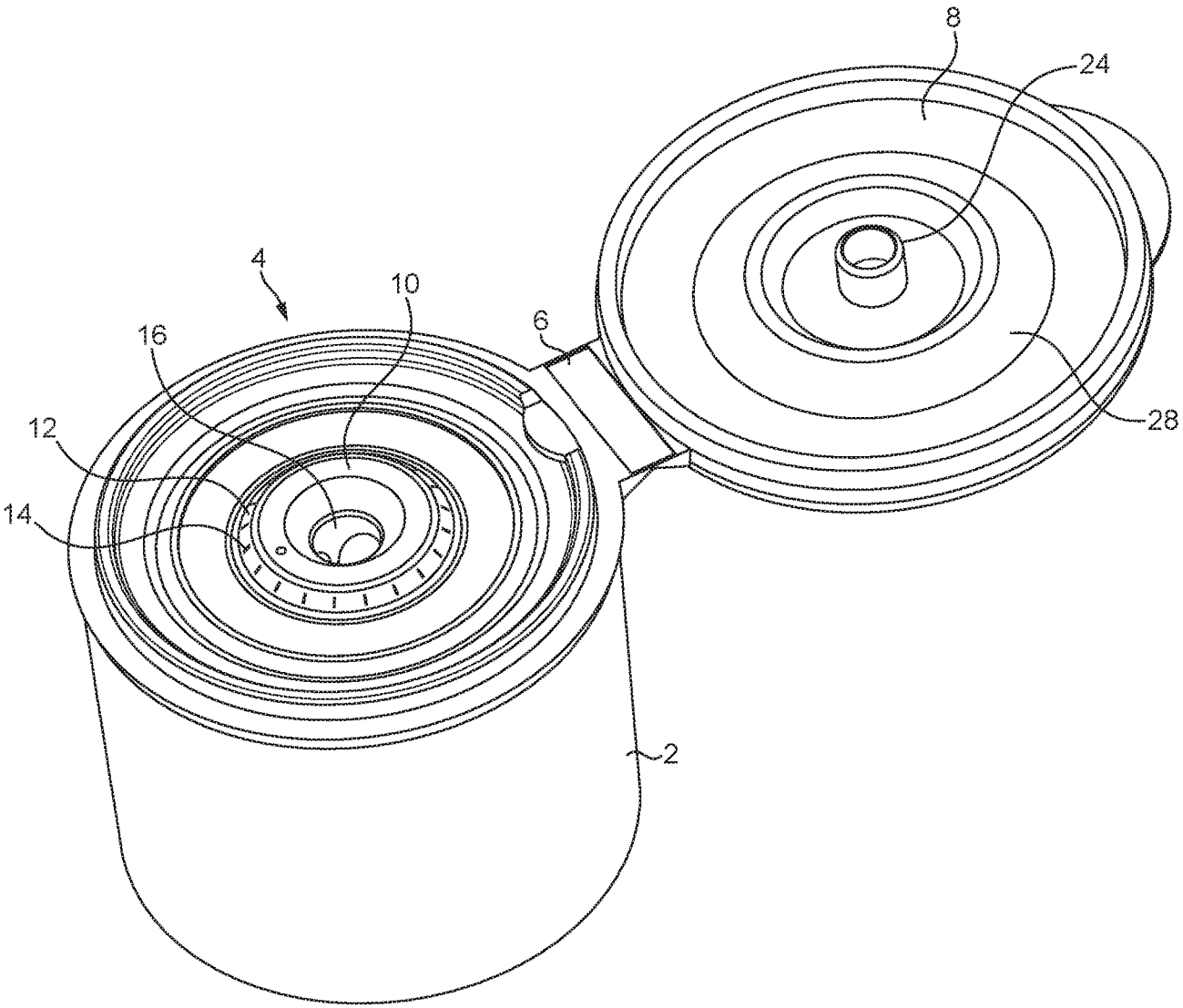
FIG. 1 is a perspective view from above of a spray cap in accordance with the invention with the lid in the open position.

The spray cap shown in the drawings is a one-piece injection moulding and consists of an outer cylindrical wall 2, whose lower end is open and whose upper end is closed by an integral circular cap plate 4. Integrally connected to the upper end of the wall 2 by means an integral hinge 6 is a pivotable cap 8. The central circular portion 10 of the cap plate is made of a relatively soft resilient thermoplastic material, e.g. a thermoplastic elastomer such as SEBS. The remainder of the cap plate and also the cylindrical wall and the cap is made of a somewhat harder and more rigid material, such as polypropylene random copolymer. The upper surface of the central portion 10 is not flat and instead includes a coaxial annular outer portion 12 whose upper surface is inclined upwardly and inwardly. Formed in this portion 12 is a plurality of relatively short spray slits 14, e.g. numbering 22 in all, though the number may be varied at will, which extend generally radially and are directed axially and outwardly. Formed in the centre of the central portion 10 is a recess 16, the shape of whose upper portion is circular. The circular wall 18 defining the circular portion of the recess merges into two downwardly extending valve plates 20, which together constitute what is effectively a duckbill valve. The lower ends of the plates 20 closely approach one another and are separated only by a narrow slit 22. The duckbill valve 20, 22 constitutes a non-return valve arranged to permit air to flow into the liquid receptacle, when the spray cap is attached to such a receptacle, when the pressure within the receptacle is sub-atmospheric but substantially to prevent the flow of air and liquid out of the receptacle towards the exterior.

The cap 8 carries a central protuberance or spigot 24, whose size, shape and position correspond to those of the recess 16. The cap 8 also carries an annular protuberance 26, a portion 28 of whose annular surface is inclined downwardly and outwardly, when the cap is in the closed position. The shape and position of the surface 28 correspond to those of the surface 12 of the central portion of the cap plate. The cap is pivotable about its hinge 6 between the open position shown in FIG. 1 and the closed position shown in FIG. 2 in which the surface 28 engages the surface 12 and thus seals the spray slits 14.

Figure 4:
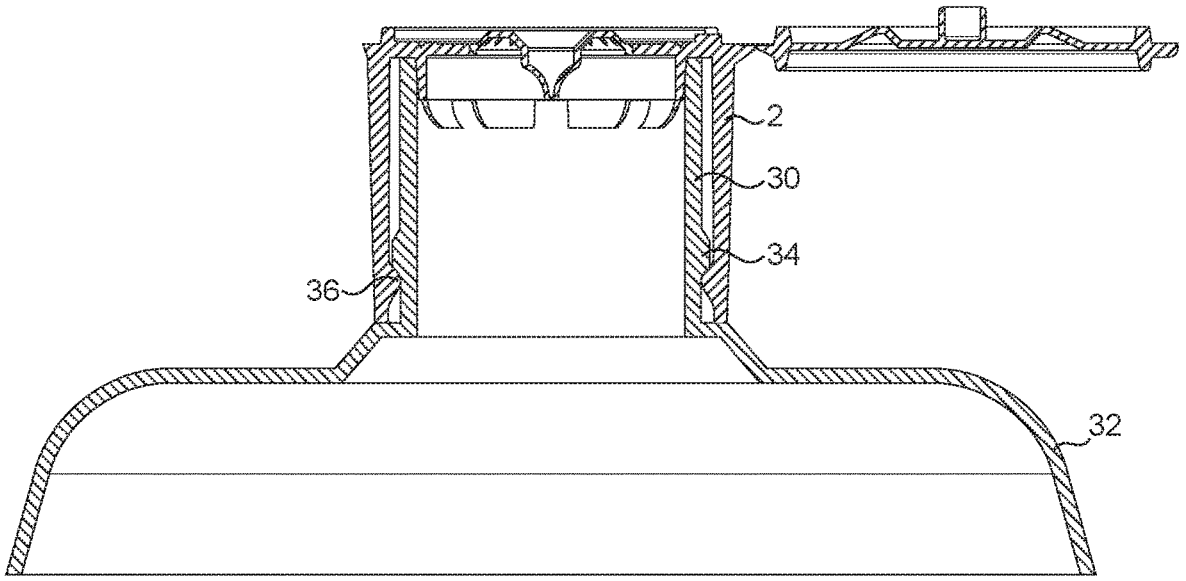
FIG. 4 is an axial sectional view of the upper portion of a spray container including the spray cap of FIG. 1.

FIG. 4 shows the spray cap attached to the cylindrical neck 30 of a receptacle for a liquid to be dispensed, such as a toilet cleaner. The spray cap may be attached to the receptacle in any desired manner but in the present case the neck 30 has an annular projecting bead 34 on its outer surface. The cylindrical wall 2 of the spray cap has a corresponding, inwardly projecting bead 36 on its inner surface. The beads 34 and 36 are so dimensioned and positioned that the spray cap may be pushed downwardly onto the neck of the receptacle with the cylindrical wall 2 surrounding the neck 30. When the bead 36 on the cylindrical wall 2 impinges against the bead 34 on the neck 30, the cylindrical wall 2 is expanded outwardly, thereby permitting the bead 36 to slide over the bead 34. When the bead 36 has passed over the bead 34, the cylindrical wall will return to its original shape with the bead 36 locked beneath the bead 34 and the upper surface of the neck 30 drawn into sealing engagement with the underside of the cap plate 4.

Figure 2:
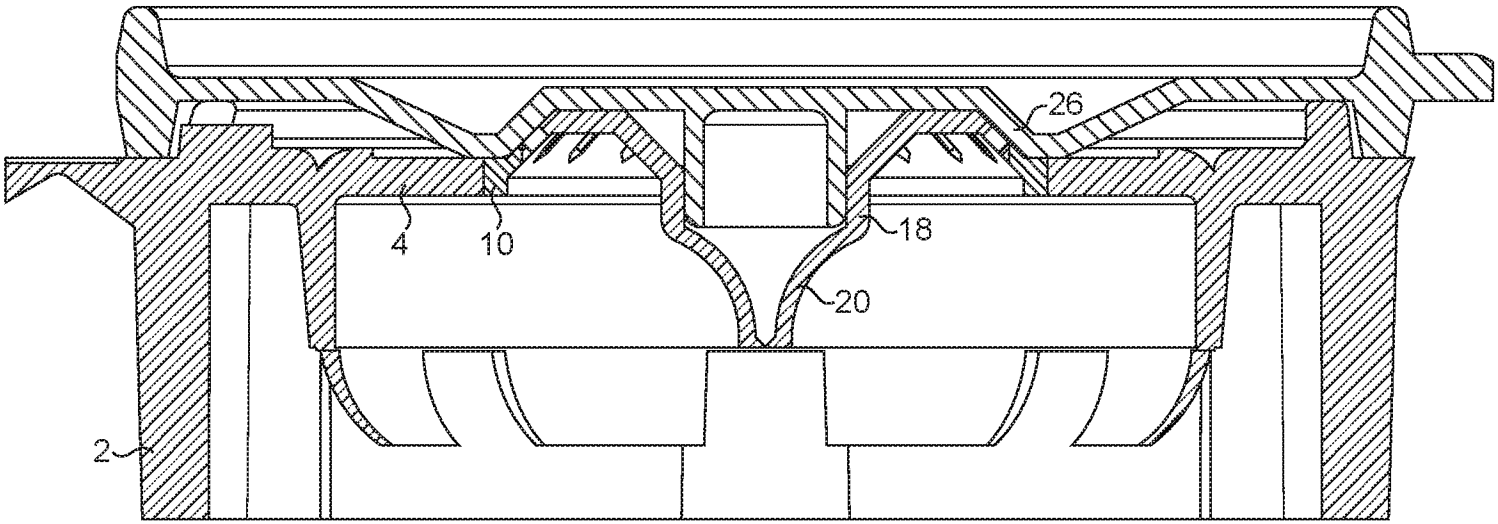
FIG. 2 is an axial sectional view of the spray cap of FIG. 1 with the lid in the closed position.
Figure 3:
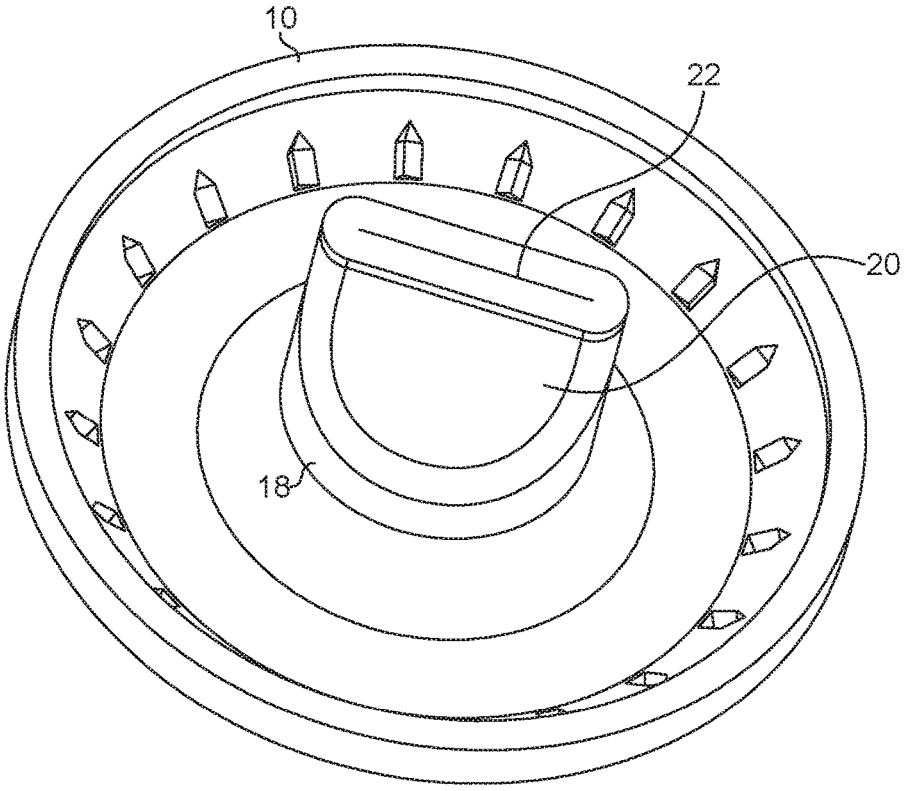
FIG. 3 is a perspective view from below of the central portion only of the spray cap of FIG. 1.

When the spray cap is to be manufactured, an injection mould is used which defines, when the mould is closed, a volume corresponding to the shape of the spray cap and lid in the configuration shown in FIG. 1. A barrier is initially positioned in the mould cavity which divides that portion which will form the central portion of the cap plate from the remainder of the cavity. A relatively soft and resilient thermoplastic material is then injected into that portion of the mould cavity which will define the central portion of the cap plate. Once this thermoplastic material has set, the barrier is removed and a somewhat harder and more rigid plastic material is then injected to fill the remainder of the mould cavity. The two portions of plastic material are therefore integrally connected together. The mould member defining the underside of the cap plate carries a number of projections, each of which has an elongate, radially extending apex, which, when the mould is closed, is spaced by only between 0.0075 and 0.075 mm from the opposing surface of the other mould member, whereby a plurality of narrow elongate gaps are defined. When the relatively soft, resilient thermoplastic is injected into the central portion of the mould cavity, the presence of these narrow gaps will result in the formation of the spray slits, as described in detail in EP2736695A. That mould member which defines the upper surface of the cap plate carries a further and very much larger projection, whose purpose is to define the internal surface of the circular wall 18 and the valve plates 20. This larger projection also has an elongate apex and when the mould is closed this apex will also be spaced from the opposed surface of the other mould member by a distance of only between 0.0075 and 0.075 mm, whereby when the thermoplastic material is injected the slit 22 is formed, as discussed in detail in EP2736695A. Both the slit 22 and also the spray slits 14 are of negligible width and, as described above, will be defined on a microscopic scale by two somewhat irregular edges whose spacing will vary along the length of the slits between substantially zero and 0.05 mm, more preferably 0.01 mm.

If it is desired to dispense liquid from the receptacle, the receptacle is inverted and pressure is applied to its flexible resilient wall 32, thereby increasing the pressure of its contents. This pressure will have the effect of making the slit 22 in the non-return valve even narrower because the pressure will act on the external surfaces of the walls 20 and push them even closer together. The pressure will have no effect on the width of the spray slits 14 and liquid will therefore pass through these narrow slits and be broken up by them, particularly as a result of their somewhat irregular shape, into a fine spray. A number of sprays equal to the number of spray slits will therefore emanate from the spray cap and as a result of the inclination of the inclined portion 12 in which the spray slits 14 are formed, these sprays will move in an axial and outward direction, thereby producing a relatively large area of coverage. Due to the fact that the non-return valve 20, 22 is substantially closed, substantially no liquid will pass through it. If a further spray is required, the receptacle is again inverted and the pressure on its side wall released. This will result in the creation of a sub-atmospheric pressure in the receptacle due to the resilience of the side wall and the action of this pressure on the outer surface of the valve plates 20 results in the slit 22 opening somewhat and thus affording a relatively large area through which air may be drawn by the sub-atmospheric pressure at a significant rate. Air will also be drawn in through the spray slits 14 but only to a very minor extent because the width of the spray slits is not influenced by the existence of a sub-atmospheric, or indeed super-atmospheric, pressure beneath them. The container therefore returns rapidly to its original shape and the spraying process may be repeated as many times as is desired. When spraying is complete, the cap 8 is pivoted about its integral hinge into the closed position shown in FIG. 2 in which the surface 28 on the cap closely abuts the surface 12 on the cap plate and thus closes the spray slits 14 and the spigot 24 is received as a sliding fit in the recess 16 in the cap plate. If desired, the external surface of the spigot 24 and the internal surface of the cylindrical wall 18 may be provided with cooperating beads which will effect a snap connection to hold the cap 8 locked in the closed position.

The invention claimed is:

1. A spray container including an open-topped receptacle with a flexible, resilient wall and a spray cap connected to the top of the receptacle, the spray cap comprising a one-piece moulding of polymeric material and including a cap plate, a plurality of spray slits formed in said cap plate and a non-return valve which is integral with said cap plate and is arranged to permit air to flow through said non-return valve in one direction which, in use, is towards the interior of said spray container but substantially to prevent the flow of air through it in the opposite direction, wherein the width of each of the spray slits varies along its length between substantially 0 and 0.3 mm.

2. The spray container and the spray cap as claimed in claim 1 wherein each of the spray slits is defined by two edges of irregular shape which substantially contact one another, at least in certain regions.

3. The spray container and the spray cap as claimed in claim 2 wherein the width of each of the spray slits varies along its length between substantially 0 and 0.1 mm.

4. The spray container and the spray cap as claimed in claim 3 wherein the width of each of the spray slits varies along its length between substantially 0 and 0.05 mm.

5. The spray container and the spray cap as claimed in claim 1 wherein the spray slits are arranged in a substantially circular array.

6. The spray container and the spray cap as claimed in claim 1 wherein the cap plate is substantially circular and the spray slits extend substantially radially.

7. The spray container and the spray cap as claimed in claim 6 wherein the cap plate includes an annular region which is inclined upwardly and inwardly and in which the spray slits are formed.

8. The spray container and the spray cap as claimed in claim 1 wherein the non-return valve is of generally duckbill type including two valve plates which are inclined towards one another and are integral with the cap plate and whose ends remote from the cap plate are biased towards one another and are separated by a slit.

9. The spray container and the spray cap as claimed in claim 1 further including inner and outer regions of different plastic materials, the spray slits formed in the inner region and the non-return valve forming part of the inner region.

10. The spray container and the spray cap as claimed in claim 9 wherein the plastic material of the inner region is softer and more resilient than the plastic material of the outer region.

11. The spray container and the spray cap as claimed in claim 1 further including a closure cap moulded integrally with the cap plate and connected to it by an integral hinge, whereby the closure cap is movable between a closed position in which it covers the cap plate and an open position in which it does not.

12. The spray container and the spray cap as claimed in claim 11 wherein the cap plate has a recess formed in its upper surface and the closure cap has a projection formed in its underside which is received in the recess in the cap plate when the closure cap is in the closed position.

13. The spray container and the spray cap as claimed in claim 12 wherein the outer surface of the projection and the inner surface of the recess carry a recess and a projection which cooperate to form a snap connection when the closure cap is in the closed position.

14. The spray container and the spray cap as claimed in claim 11 wherein the closure cap includes a region on its underside which is shaped and positioned so that it comes into contact with the region of the cap plate in which the spray slits are formed, when the closure cap is in the closed position, whereby the spray slits are closed.

15. The spray container and the spray cap as claimed in claim 3 wherein the width of each of the spray slits varies along its length between substantially 0 and 0.01 mm.

16. A spray cap for a spray container, the spray cap comprising:

a cap plate;

a cylindrical wall depending from the cap plate;

a recess formed in the cap plate;

an upwardly and inwardly inclined annular region formed in the cap plate about the recess;

a plurality of spray slits formed in the inwardly inclined annular region of the cap plate; and a non-return valve extending from the recess, the non-return valve arranged to permit air to flow through said non-return valve in one direction which, in use, is towards an interior of the spray container but substantially to prevent the flow of air through it in the opposite direction;

wherein the spray cap is a one-piece moulding of polymeric material.

17. The spray cap as claimed in claim 16 further including inner and outer regions of different plastic materials, the spray slits formed in the inner region and the non-return valve forming part of the inner region, wherein the plastic material of the inner region is softer and more resilient than the plastic material of the outer region.

18. The spray cap as claimed in claim 16 further including a closure cap moulded integrally with the cap plate and connected to it by an integral hinge, wherein the closure cap includes a projection formed on an underside thereof that is received in the recess formed in the cap plate in a snap connection when the closure cap is in a closed position.

19. The spray cap as claimed in claim 16 further including a closure cap moulded integrally with the cap plate and connected to it by an integral hinge, wherein the closure cap includes a region on its underside which is shaped and positioned so that it comes into contact with the upwardly and inwardly inclined annular region formed in the cap plate, when the closure cap is in the closed position, to thereby close the spray slits.

* * * * *